US006241490B1

(12) United States Patent
Rippl

(10) Patent No.: US 6,241,490 B1
(45) Date of Patent: Jun. 5, 2001

(54) MULTIROTOR VACUUM PUMP

(75) Inventor: Christopher Mark Rippl, Wetzlar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/262,141

(22) Filed: Mar. 3, 1999

(30) Foreign Application Priority Data

Mar. 7, 1998 (DE) ..... 198 09 957

(51) Int. Cl.[7] ..... F04B 17/00; F01C 1/08
(52) U.S. Cl. ..... 417/410.4; 418/191
(58) Field of Search ..... 417/410.4; 418/3, 418/88, 94, 191

(56) References Cited

U.S. PATENT DOCUMENTS

Re. 32,055 * 12/1985 Schibbye et al. ..... 418/94
3,969,042 * 7/1976 Bachler ..... 417/354
4,457,680 * 7/1984 Gable ..... 418/88
4,551,073 * 11/1985 Schwab ..... 417/410
4,770,609 * 9/1988 Uchida et al. ..... 418/3
5,051,060 * 9/1991 Fleischmann et al. ..... 417/366
5,346,361 * 9/1994 Jurgill et al. ..... 415/111
5,927,863 * 7/1999 De Bock ..... 384/468

* cited by examiner

*Primary Examiner*—Timothy S. Thorpe
*Assistant Examiner*—Michael K. Gray
(74) *Attorney, Agent, or Firm*—Brown & Wood, LLP

(57) ABSTRACT

A multirotor vacuum pump including a housing, at least two rotors located in the housing and cooperating with each other so that as a result of a contactless movement of the at least two rotors relative to each other, working chambers, into which a to-be-pumped gas is fed, are formed, with at least one of the at least two rotors being hollow, and a drive formed as an external rotor motor having its rotor elements arranged on an inner surface of the at least two rotors, and stator elements fixedly mounted inside the at least one of the at least two rotors opposite the rotor elements.

6 Claims, 3 Drawing Sheets

MULTIROTOR VACUUM PUMP

BACKGROUND OF THE INVENTION

FIELD OF THE INVENTION

The present invention relates to a multirotor vacuum pump including at least two rotor arranged in the pump housing and cooperating with each other so that as a result of their mutual contactless movement relative to each other, working chambers, into which a to-be-pumped gas is fed, are formed.

Multirotor vacuum pumps of the type described above find a particularly wide application in chemical industry and in semiconductor technology as dry pump systems. Dry pump systems are characterized in that no oil is contained in their compression or expansion chambers for lubrication, reduction of a dead volume and similar purposes. Therefore, they are capable of producing a completely hydrocarbon-free vacuum. To obtain optimal pumping characteristics, a plurality of pump stages can be arranged in a single one after another.

In conventional multirotor vacuum pumps, two or more pistons are rotatably arranged in a single housing. The pistons are mounted on shafts supported in bearing plates arranged at one or both of opposite ends of a shaft. The rotation of the pistons is synchronized by gear sets so that a uniform rolling off of the pistons without any contact there-between, with maintaining minimal clearances, can take place. The bearings and the gear sets should be separated from the working chambers with suitable seals to prevent oil or similar working medium from penetrating into the chambers and to prevent, on the other hand, the pumped harmful gases from penetrating into the gear sets and the space, where the bearing are located, as these gases can contaminate or even destroy the lubricant. The sealing can be effectively established by using a seal gas.

In the conventional multirotor vacuum pumps, the drive motor is located outside of the pump housing and, for its connection to the main shaft, a shaft leadthrough is necessary. Dependent on the pump use and/or design, one or more rather expensive seals need be provided for the shaft leadthrough.

A serious drawback of the conventional pumps of the above-described type consists in their rather expensive construction. This results from relative large dimensions of the pump, numerous pump components, and from their rather complicated assembly. Moreover, such important components of a pump as seals between separate stages, seal gas arrangements, and elements of oil supply are often unaccessible in the known construction and need much improvement.

Accordingly, an object of the present invention is to provide a dry multirotor vacuum pump in which the foregoing drawbacks are eliminated.

A further object of the present invention is to provide a dry multirotor vacuum pump which while insuring optimal pump characteristics, would have small dimensions which would insure a space-saving and easy mounting of the pump.

A still further object of the present invention is to provide a dry multirotor vacuum pump in which the seals, the seal gas elements and the elements of the oil supply are optimally adapted to the novel concept of the pump.

SUMMARY OF THE INVENTION

These and other objects of the present invention, which will become apparent hereinafter, are achieved by providing a dry multirotor vacuum pump of the type described above in which at least one of the at least two rotors has a hollow somewhat bell-shaped profile, and the drive is formed as an external rotor motor having the rotor elements arranged on an inner surface of the at least one of the at least two rotors, and stator elements fixedly mounted inside the at least one of the at least two rotors opposite the rotor elements.

The rotors occupy a very large portion of the pump volume. This space until now has not been used because of the large dimensions of the rotors. By providing at least one hollow rotor having a bell-shaped profile, it became possible to completely integrate the drive system in the interior of this rotor and, thus, use the space which until the present time has not been used. This reduces the dimensions of the pump to a substantial degree.

The locations of the bearings are encapsulated with respect to the pumping space, and the need for shaft leadthrough has been eliminated. The novel design of the dry multirotor vacuum pump provides additional advantages which consist in that the electrical conductors for feeding power to the drive elements and the cooling medium conduits can be arranged in the shaft of the main rotor.

A bell-shaped profile is a structure that results in a large diameter of the rotor. In case of a multirotor pump, with the stages being arranged axially one behind the other, there exists a problem of providing appropriate sealings between the stages. E.g., providing radial shaft seals results in high speeds at the border surfaces because of large diameters. This leads to unacceptable high temperatures and to wear. In addition, it is desirable that the seals act in direction opposite to the return flow between stages. In order to take these conditions into account, it is proposed to provide contactless seals between the stages and formed as screw pumps. The screw pump provide for a pressure ratio acting opposite to the return flow.

To insure that no oil penetrates into the pumping space and, vice versa, no process gas penetrates into the gear set space, it is necessary to create a seal gas barrier between the gear set space and the pumping space. A critical problem here is metering. Because as a seal gas, as a rule, an inert gas is used, it is necessary to keep the gas consumption low. On the other hand, no risk should be taken to endanger the sealing function by using a too little gas amount. To fulfill these contradictory requirements, until now, rather expensive seal gas devices for controlling the seal gas pressure, for monitoring the seal gas sealings, and the like were necessary. According to the invention, to keep an optimal gas consumption, elements of the seal gas sealing are formed of a porous material, with the seal gas consumption being dependent on the wall thickness of the seals and the permeability of the porous material. At that, care should be taken that the seal gas pressure is above the range in which blocking of the seal material takes place. Because of the distribution of the seal gas in the sealing and along the surfaces defining a clearance between seals and the rotor, a gas cushion is provided which prevents a gas exchange between the gear set space and the pumping space.

For feeding oil to the bearings, symmetrically arranged screw pumps, which are arranged on the inner side of the control rotor, are used. For further delivery of the oil, according to the invention, bores are formed inside respective shafts. This also promotes an optimal use of the available space.

The inventive pump has a compact construction while insuring, at the same time, optimal pump characteristics. It also makes possible an easy space-saving mounting of the inventive pump. At that, the components of the power supply, cooling medium supply, and sealings can be optimally adapted to the new pump design.

BRIEF DESCRIPTION OF THE DRAWINGS

The features and objects of the present invention will become more apparent, and the invention itself will be the best understood from the following detailed description for the preferred embodiments when read with reference to the accompanying drawings, wherein.

DESCRIPTION OF THE PRESENT INVENTION

Figure 1:
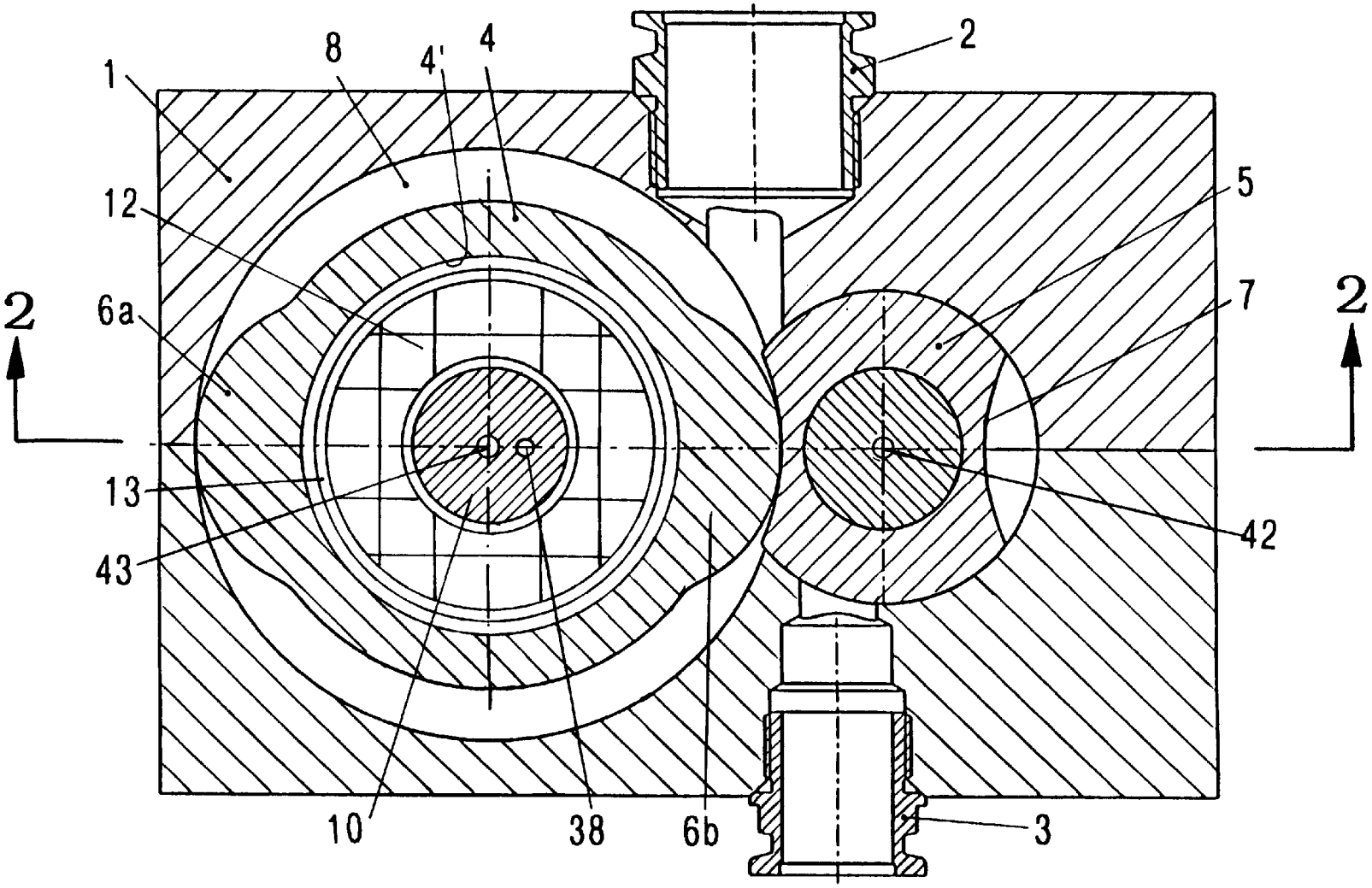
FIG. 1 shows a cross-sectional view of a two-shaft vacuum pump according to the present invention taken along line 1—1 in FIG. 2.
Figure 2:
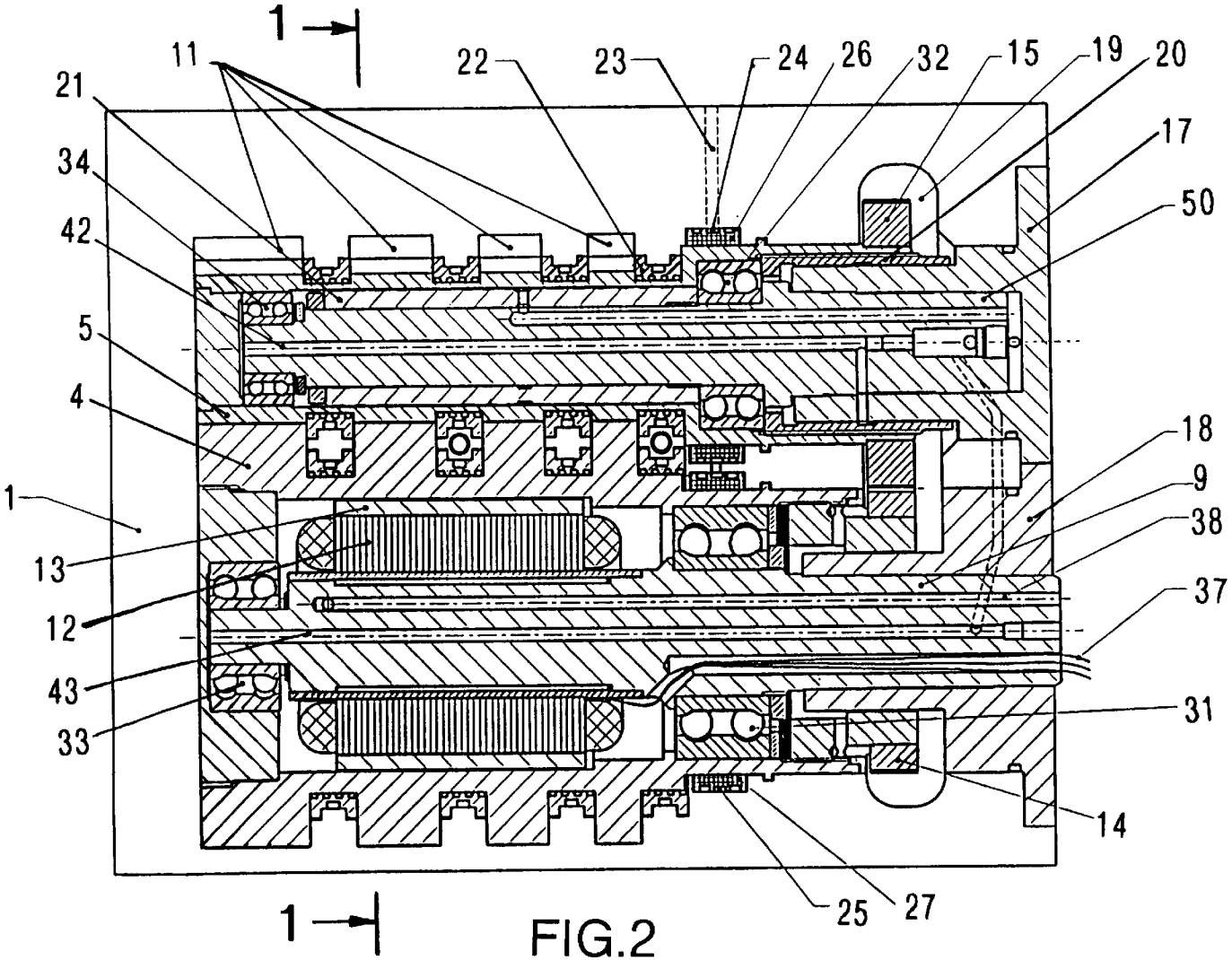
FIG. 2 shows a cross-sectional view along line 2—2 in FIG. 1.

A two-shaft vacuum pump according to the present invention, which is shown in FIG. 1, has a pump housing 1 provided with a suction flange 2 and a gas outlet 3. A primary shaft 4, which would further be referred to as a main main rotor 4 and a further, control rotor 5 are supported in the housing 1 in two respective pairs of bearings 31, 33 and 32, 34, as shown in FIG. 2. The outer profile of the main rotor 4 is so formed that is has two working lobes 6. The control rotor 5 is provided with two recesses 7 corresponding to the working lobes 6 of the main rotor 4. The pumping effect is obtained, in per se known manner, by cooperation of the main rotor 4 with the control rotor 5. Both the main rotor 4 and the control rotor 5 are hollow, with the main rotor 4 having somewhat bell-shaped profile. This shape of the rotors permits to arrange further pump components inside the rotors. Thus, the pump drive is arranged inside the main rotor 4. The drive is formed as an external rotor comprising rotor elements 13 and stator element 12 motor. The rotor elements 13 of the external rotor motor are provided on the inner surface 4' of the hollow bell-shaped main rotor 4. The stator elements 12 of the drive are fixedly mounted inside the main rotor 4 opposite the rotor elements 13. The bearings 31, 33 and 32, 34 are mounted inside the respective main rotor 4 and the control rotor 5 on respective pairs of shafts 9, 10. The shafts 9 and 10 are fixed to the housing 1 with flanges 18 and 17. The rotary movement is transmitted from the main rotor 4 to the control rotor 5 via a gear set formed of gears 14, 15 located in a gear space 19. The electrical conductors 37 for feeding power to the stator elements 12 of the drive extend through a bore 36 formed in the shaft 9 of the main rotor 4, and a cooling medium conduit is defined by above 38 formed in the shaft 9 of the main rotor 4.

In a multistage embodiment of the pump, which is shown in FIG. 2, contactless seals 22, which are axially arranged one after another, are provided between the separate stages 11. The seals 22 are formed as screw pumps which act opposite to the return flow.

To provide a seal between the gear set space 19 and an adjoining chamber 8, a seal gas is fed through a seal gas inlet 23, annular channels 24 and 25, and seal gas gaskets 26 and 27. The seal gas gaskets 26 and 27 are formed of a porous material. A metered feeding of the seal gas is insured by appropriate selection of the material and shaping of the gasket.

Oil is fed to the bearings 31, 33 and 32, 34 by screw pumps 20 and 21 which are provided on the inner side of the control rotor 5 and are symmetrically arranged. They pump oil in opposite axial directions, with the oil exiting in the middle. The oil is fed to the bearings 31, 33 and 32, 34 through bores 42, 43 in shafts 9 and 10.

Figure 3:
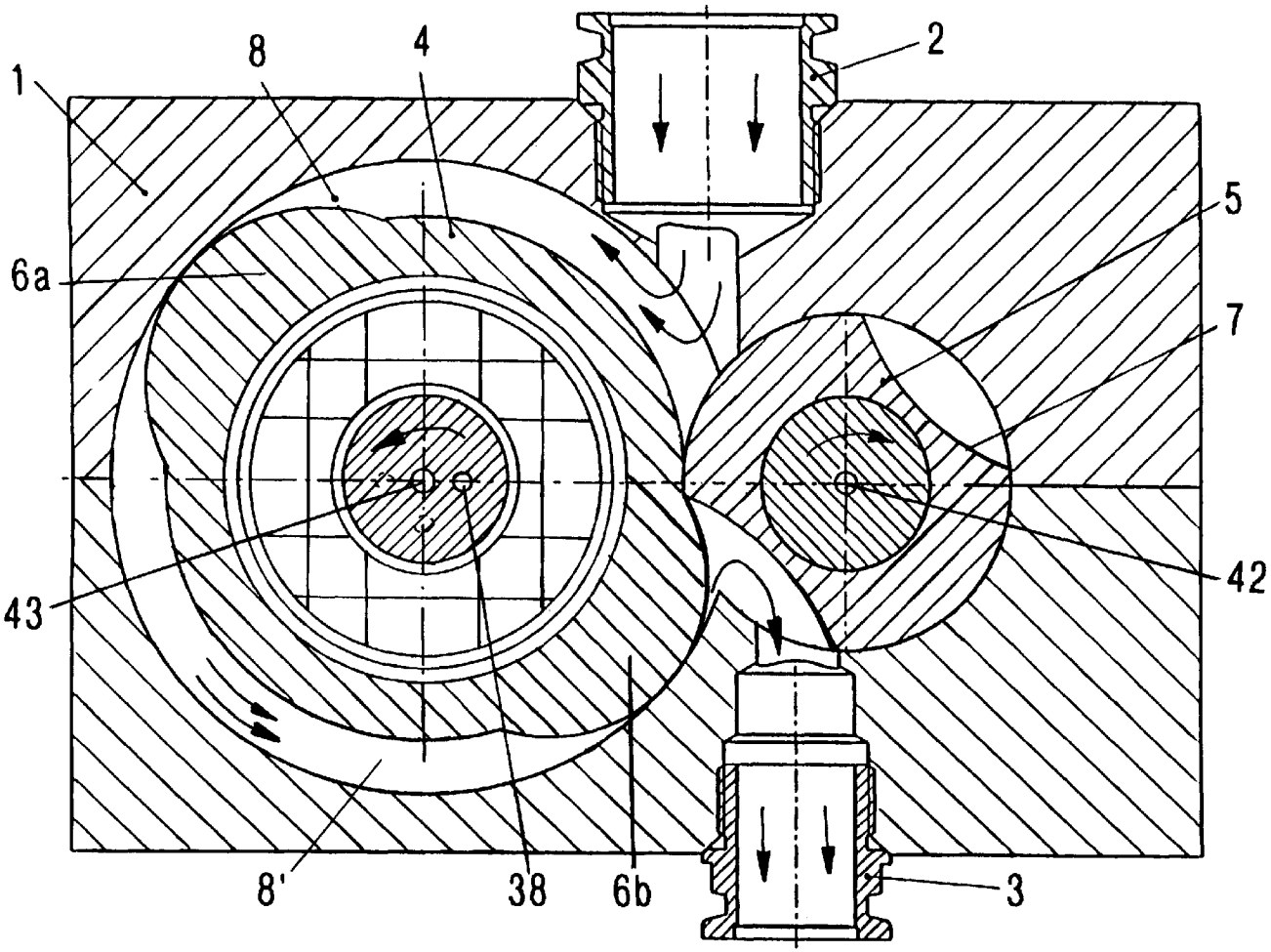
FIG. 3 shows a view similar to that of FIG. 1 but in a different position of the rotors.

The operation of the pump will now be described primarily with reference to FIG. 3. Upon feeding of the electrical power through the electrical conductors 37 to the stator elements 12, the rotor elements 13 start to rotate, together with the main rotor 4 with which they are connected for joint rotation therewith. The rotational movement to the control rotor 5 is transmitted through the gear set 14/15. The gear 14 is connected with the main rotor 4 and transmits its rotational movement to the gear 15 connected with the control rotor 5 for joint rotation therewith. Upon actuation of the pump, the processed gas is aspirated through the suction flange 2 into the working chamber 8 defined by the main rotor 4 and the housing 1 and is delivered from another working chamber 8 through the outlet 3. The gas flew through the pump is shown in FIG. 3 with arrows.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A vacuum pump, comprising:

a pump housing (1) having an inlet (2) and an outlet (3);

a main rotor (4) having a first bell-shaped lobe **(6*a*) and a second bell-shaped lobe (6*b*), said main rotor (4) being positioned inside said housing (1) such that said first and second bell shaped lobes (6*a*, 6*b*) define a working chamber (8)** with said pump housing;

a rotor drive element (13) contacting said main rotor for rotating said main rotor (4), said rotor drive element being positioned radially inward from said main rotor and opposite to a stator element (12) positioned radially inward from said rotor drive element (13);

a control rotor (5), said control rotor (5) being provided with at least one recess (7) for accommodating at least one of said first and second lobes **(6*a*, 6*b*); and wherein upon said main rotor being driven so as to rotate, fluid is pumped from said inlet (2) through said working chamber (8) and to said outlet (3)**.

2. A vacuum pump according to claim 1, a first stationary shaft (10) around which said main rotor (4) rotates, said first stationary shaft being provided bearings (31, 33) for support;

a second stationary shaft (50) around which said control rotor (5) rotates, said second stationary shaft being provided with bearings (32) for support.

3. A vacuum pump according to claim 1, further comprising:

an electrical conductor element (37) formed in a bore (36) of said first stationary shaft (10), said electrical conductor element contacting said stator element (12).

4. A vacuum pump according to claim 1, further comprising:

a cooling medium conduit (38) defining a bore formed in said first stationary shaft (10).

5. A vacuum pump according to claim 2, wherein:

lubricant oil is delivered to said respective bearings (31, 32, 33) through bores formed in said first stationary shaft (10) and said second stationary shaft (50).

6. A vacuum pump according to claim 3, further comprising:

a first gear (14) connected to the main rotor (4) and a second gear (15) connected to said first gear (14) and said control rotor (5) such that rotary movement is transmitted from the main rotor (4) to the control rotor (5).

* * * * *